United States Patent [19]

Blom et al.

[11] 4,058,158

[45] Nov. 15, 1977

[54] REGENERATIVE AIR PREHEATERS AND SEAL FRAME SUSPENSION CONTROL SYSTEM THEREFOR

[75] Inventors: Johannes Cornelis Blom, Belfast; Colin Edward Tindall, Ballynahinch, both of Northern Ireland

[73] Assignee: Davidson & Co. Limited, Belfast, Northern Ireland

[21] Appl. No.: 708,424

[22] Filed: July 26, 1976

[30] Foreign Application Priority Data

Nov. 4, 1975 United Kingdom ..... 45783/75

[51] Int. Cl.[2] ..... F28D 17/00

[52] U.S. Cl. ..... 165/9

[58] Field of Search ..... 165/9

[56] References Cited

U.S. PATENT DOCUMENTS 3,232,335 1/1966 Kalbfleisch ..... 165/9

3,880,225 4/1975 Penny ..... 165/9

*Primary Examiner*—Albert W. Davis, Jr.

*Attorney, Agent, or Firm*—Cushman, Darby & Cushman

[57] ABSTRACT

A rotary regenerative air preheater has electromagnetic drive devices to adjust the relationship between an end face of the regenerative mass and a sealing frame on a duct part. Electrical control means are responsive to signals generated by contact between the sealing shoe (or special sensors) borne on the frame and the end face, to drive the electromagnetic devices and break the contact. The control may be on/off, a time response such that a desired maximum clearance is experienced, or may be responsive to drag (i.e., the angle of arc over which contact is experienced). The electromagnetic drive devices are inherently self adjusted by having an air gap in their flux circuit which varies in dependence on the position of the sealing frame.

13 Claims, 6 Drawing Figures

REGENERATIVE AIR PREHEATERS AND SEAL FRAME SUSPENSION CONTROL SYSTEM THEREFOR

FIELD OF THE INVENTION

The present invention relates to regenerative air preheaters and seal frame suspension control system therefor. It will here be described with reference to the type of air preheater in which movable air hoods rotate within stationary heating gas ducts on the axial end faces of a stationary, cylindrical, regenerative matrix, but the electromagnetic devices and associated control circuitry could equally well be used with other types of air preheaters such as air preheaters in which a cylindrical regenerative matrix rotates between stationary ducts.

BACKGROUND OF THE INVENTION

The setting of the end seals which prevent leakage of heat-exchange media at the end faces of a regenerative heat-exchange mass is a matter of importance. Sealing frames are borne on one part, here the rotating hoods, and these rotate over a planar end face, in this case on a static regenerative mass. If the sealing frames are held clear of the end face there will be leakage; if they press together there will be wear. To relieve the pressure at this interface the sealing frames have been isolated from their supporting structure by spring-loading so that only a small portion of the weight of the frame (on an upper end face) or only a small component of force due to the springs (on a lower end face) is used to urge the two into contact. This type of system was either completely uncontrolled (so that with variation in temperature, or temperature gradients across the regenerative mass, there was a risk of unduly large clearances developing or unduly large pressures being exerted) or was controlled by a mechanical drive which adjusted the spring tension, either as a result of manual initiation of the drive, or automatically in response to temperature sensed in the regenerator.

SUMMARY OF THE INVENTION

The present invention proposes providing electromagnetic drive means which drive that frame axially clear of the end face of the mass, and automatic control for that drive means. The control is responsive to contact between seal and mass and is arranged so that the relationship is that which is desired in any one of a number of control strategies.

This is a system therefore which does away with the problem of avoiding excessive clearance and excessive wear by electromagnetically adjusting the setting of the sealing frame as a result of signals generated in the regenerator by the very elements to be controlled.

Broadly, we provide a seal frame position control system for a regenerative air preheater which system has a plurality of electromagnetic devices to be operatively attached to a sealing frame of the preheater to cause movement of the frame in an axial direction, and electrical control means arranged and adapted to control operation of the electromagnetic devices to tend to control the relationship in the axial direction between the seal frame and axial end face of a regenerative matrix of the preheater. We provide also a preheater equipped with such devices and control means at a plurality of positions about the frame. Preferably the electrical control means will independently control devices at respective positions.

The number of such devices needed will depend primarily upon the size of the preheater. The operation of the devices is such that the sealing gap between the sealing frames and the end face of the matrix is maintained at a constant value at all points of the sealing circumference, irrespective of any thermal distortion of either the stationary or rotating components of the preheater. The sealing gap between the end face and the outer circumferential parts of the sealing frames should ideally be maintained at a value of not more than 1 mm.

The preheater may be one of the stationary matrix type, in which case the seal frames are borne on hoods rotating at at least one of the end faces of the matrix.

An electrical control system preferred from the point of view of simplicity is one which responds to electrical contact being made between a seal frame part and the axial end face to tend to withdraw the seal frame.

Preferably the electro-magnets act in conjunction with an arrangement of mechanical springs to provide an integrated sealing frame suspension system. The spring settings would normally be such that, for maximum gas temperature and the resulting thermal distortion, a circumferential sealing gap of approximately 1 mm results with all electro-magnets inoperative. For lower gas temperatures, and a lesser degree of thermal distortion, the tendency is for the sealing gap to reduce until the sealing frames make contact with, and drag against the axial end face of the regenerator matrix. In order to rectify this situation and thus minimize seal wear contact between the seals and end face is sensed and one of a number of possible control strategies is initiated. The objective common to these control strategies is to lift the seals free, or almost free, of the axial end face, the electro-magnets being required to provide a minimum force equal to the seal weight minus the appropriate spring force.

DESCRIPTION OF THE DRAWINGS AND OF A PREFERRED EMBODIMENT

A particular embodiment of the invention will now be described with reference to the accompanying drawings wherein.

Figure 1:
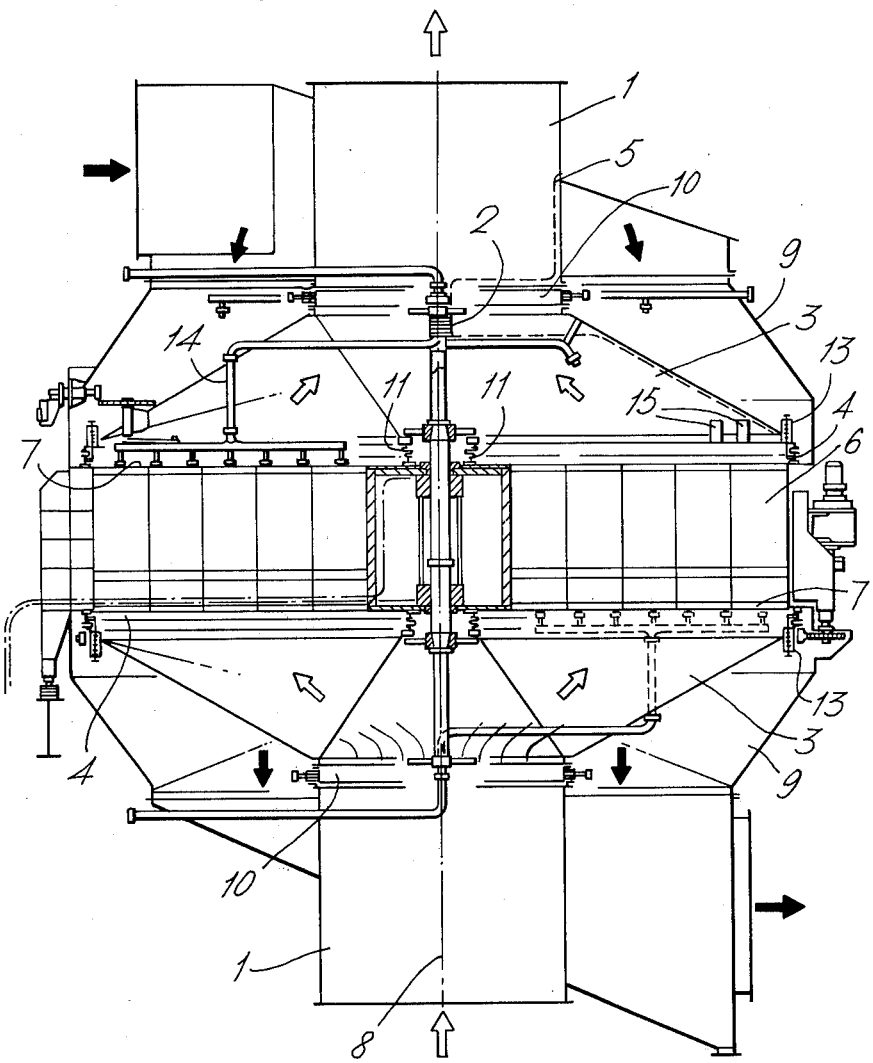
FIG. 1 is a side view of a rotary regenerative air preheater.
Figure 6:
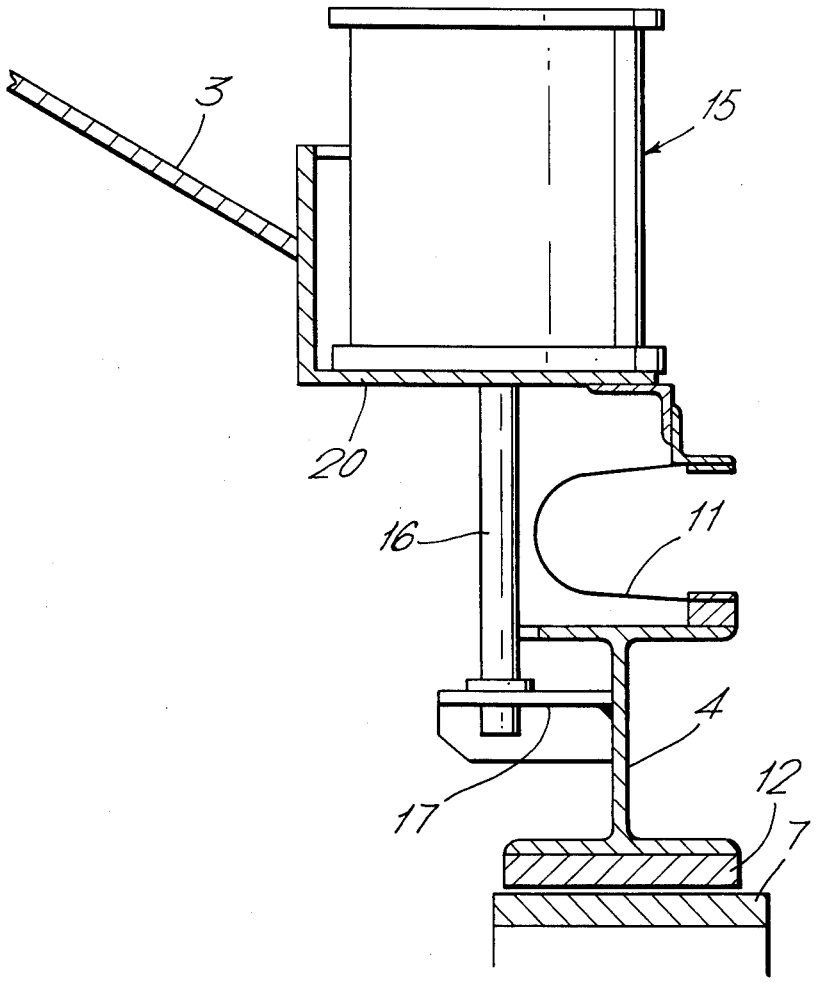

In FIG. 1, a rotary regenerative air preheater has a stationary cylindrical matrix 6 over both axial end faces 7 of which move hoods 3 which rotate about an axis 8 which is also the center axis of the matrix 6. The hoods are contained within stationary duct 9 which direct the flow, shown by dark arrows, of a gas such as boiler exhaust gas which is to give up heat to a heat-exchange mass in the matrix 6. A medium such as air flows as shown by hollow arrows through stationary inlet and outlet ducts 1 and through the hoods 3 to pass through the heat-exchange mass and take up heat from it. To maintain separation of the two media sealed bearings are provided at 10 between the ducts 1 and hoods 3 and a sealing shoe 12 (see also FIG. 6) borne by a seal frame 4 on the hoods slides on or just over the axial end faces 7 of the matrix. Expansion joint arrangements such as bellows 11 allow relative axial movement between the frames 4 and hoods 3.

The weight of the frames 4 and parts fast with them is almost balanced by spring-loaded pins 13 acting between the hoods and frames. Ancillary equipment such as soot-blowers 14 may also be rotatably borne on the central axle.

Thus far, the structure is conventional. The invention is concerned with actively controlling the axial relationship between the end faces 7 and the frames 1, and electromagnetic devices 15 are provided for this purpose. One embodiment of the electro-magnetic devices and control system by which control is achieved will now be described.

Figure 2:
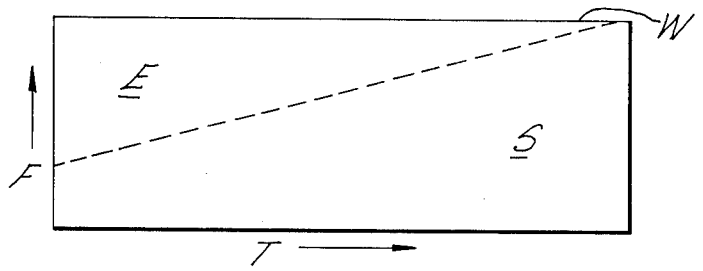
FIG. 2 is a graph of a desired relation between force due to the electro-magnets, spring force and gas temperature.

It is clear that variations in gas temperature, with consequent variations in the distortion experienced by the matrix, will affect the correctness of the setting of the frames if a constant force due to the springs is all that acts upon them. The force contributions of the springs of the spring loaded pins 13 against the contribution E due to the electro-magnetic devices to maintain theoretically a constant setting in a hot-end frame (the upper frame in FIG. 1) where the weight to be supported is W is shown diagrammatically in FIG. 2. The abscissa is temperature and the ordinate, total force. As can be seen, as temperature rises the spring force contribution S becomes progressively more important than the contribution E from the electro-magnetic devices.

Figure 3:
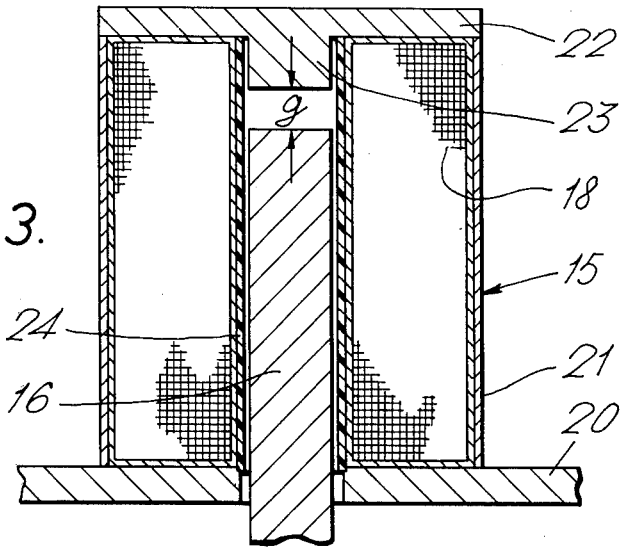
FIG. 3 is a section through an electro-magnet.

A preferred electro-magnet device 15 which has been designed for the purpose described above is illustrated by FIG. 3. It has an 'iron' (magnetic) circuit, part of which is a movable ferromagnetic armature 16 which is attached to a lug 17 welded to the seal frame 4 (FIG. 6) the remainder of the magnet including its coil 18 being mounted on a frame 20 of the rotating air hood 3. The magnetic circuit includes also a pipe or pot 21 surrounding the coil 18 and an end plug 22 having a portion 23 projecting into a central passage of the electro-magnet. When the coil 18 surrounding the armature 16 is energised, the armature experiences an attractive elctromagnetic force, the magnitude of which is a function of the dimensions of the magnet, the magnetic characteristics of the ferromagnetic material, the current flowing in the coil, and the variable air gap '*g*' in the magnetic circuit (see FIG. 3). The air gap '*g*' is itself dependent upon thermal distortion and thus temperature because the armature is associated with the seal frame, and the coil 18 and end plug 22 with the air hood 3. The devices 15 and their control circuitry are designed so that at any temperature, the attractive electro-magnetic force produced when the magnet coils are energized, is sufficient to lift the seal frames so that their shoe parts 12 come axially free of the stator end face.

The coils 18 of the electro-magnet consist of a stack of rolls or coils of anodized aluminum strip, the aluminum oxide coating on the conductor being necessary for electrical insulation at the high operating temperatures of the preheater. Other insulation, such as that required between layers, between coils and former, and for the end connections is provided by woven ceramic material in the form of pads, tape or sleeving. The coils are positioned about a non-magnetic coil former sleeve 24 which also acts as a sliding bearing for the armature 16.

THE CONTROL SYSTEM AND CIRCUITRY

Figure 5:
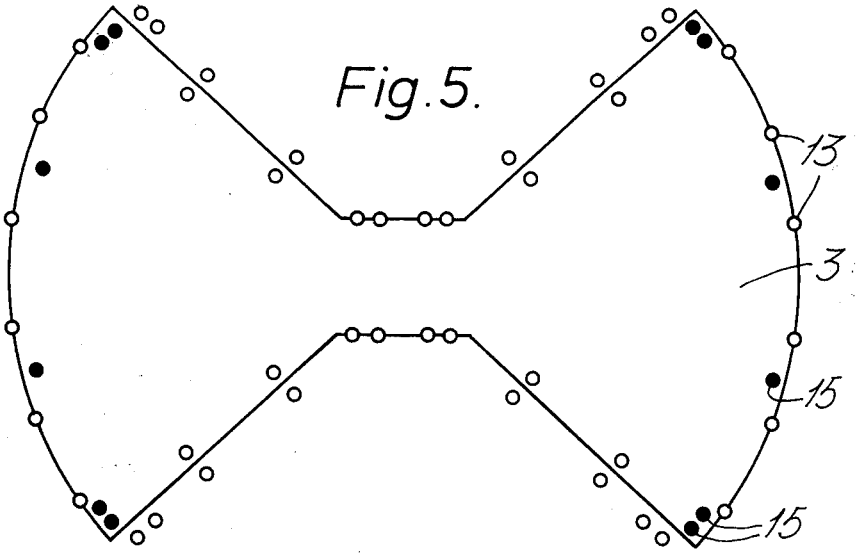
FIG. 5 shows in plan a distribution of control devices and spring pins around a rotatable pair of hoods and, FIG. 6 is a detail, partly in section, of one control device.

A number of magnets is used on any given preheater and these are placed at strategic points around the seal stator interface. One possible arrangement is seen in FIG. 5 where the blade-shaped outline represents the circumference of one hood 3, hollow circles 13 represent the position of spring loaded pins 13 and full circles represent the position of electro-magnets 15. The position of the magnets, relative to the springs which comprise the remainder of the suspension system, are carefully chosen, and one or more magnets may be situated in any particular control sector, the magnet or magnets in each sector preferably being controlled separately from those in any other sector. The resulting sectionalized system is then better able to adjust the clearance between the stator end face 7 and the seals 4, peripheral irregularities and uneven distortion then being more satisfactorily accounted for.

Figure 4:
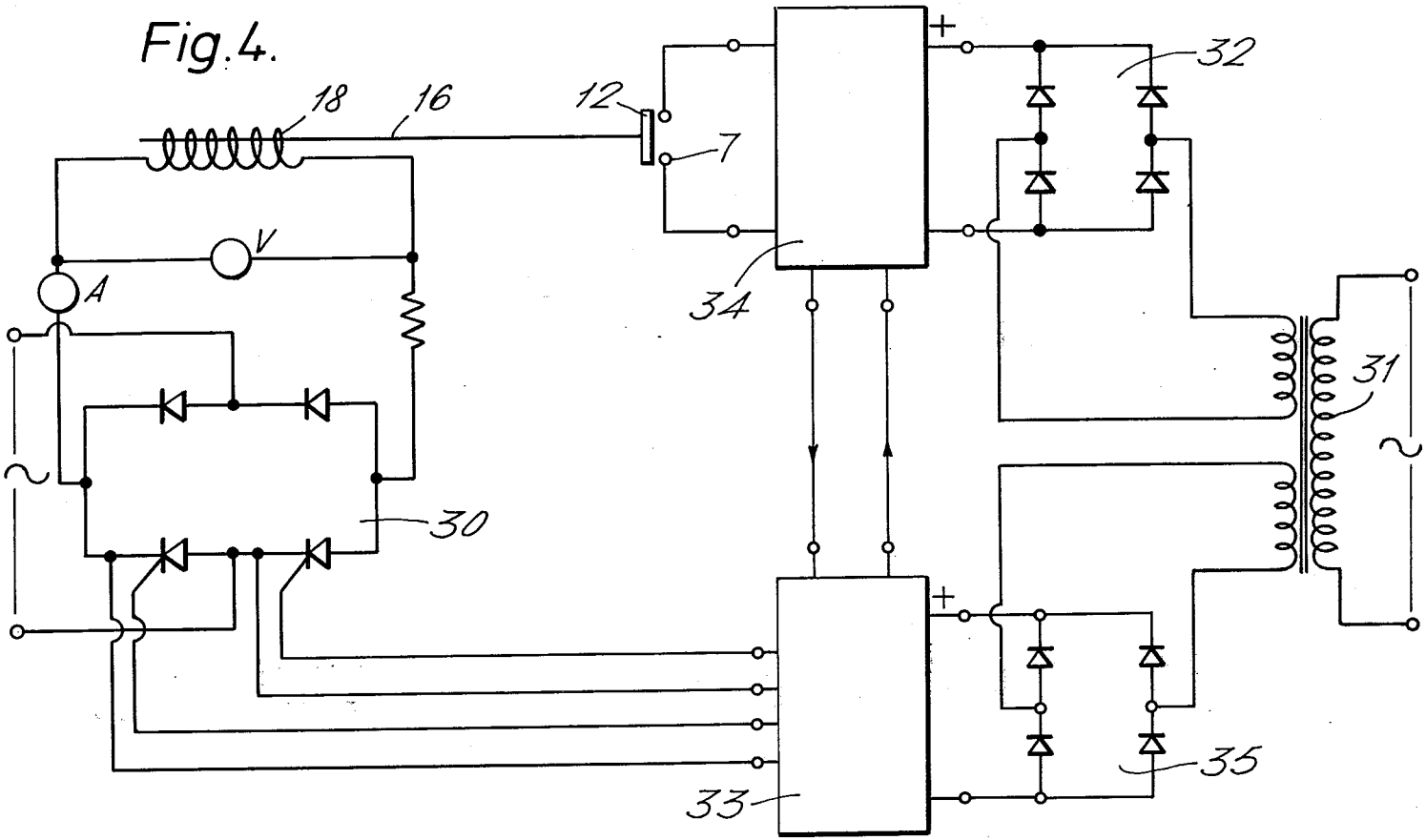
FIG. 4 is a circuit diagram of a control circuit.

Control circuitry for a magnet or group of magnets is seen in FIG. 4.

The magnets are energised with direct current derived from the a.c. mains via solid state rectifiers, the use of thyristors or other controllable semi-conductor devices being necessary. As stated above, the magnet or magnets in each control sector must be provided with a separate, controlled supply and an exclusive control signal if independent operation is to be achieved of the magnets or of the sectors of magnets, as the case may be. The coil or coils 18 in each control sector are therefore fed via an individual controlled bridge rectifier, or some other source of variable direct current, and the control signals are produced by contact between the seal shoe 12 or other conact-making element on the hood 3 and the stator. For example, the seal shoe 12 may be segmented, each segment carrying a signal current and being electrically insulated from all other rotating parts of the preheater, or there may be provided small segmental sensing shoes integral with, or attached to, the seals and insulated from the seals. These conducting seals segments or sensing shoes are fed with low voltage direct current via slip rings 2 mounted on the main axle, or some other form of sliding contact, and the stator provides a common return path, as is apparent from FIG. 1.

When contact is made between a rotating, conducting seal segment or sensing shoe and the stator end face, a signal current flows in the control circuitry of the appropriate control sector. This signal is used to initiate some new adjustment to the state of the system, depending upon the control strategy in use. If the seal segment or sensing shoe is lifted clear of the stator end face, the signal current ceases to flow and once again an adjustment is made to the state of the system. This simple binary control signal is the basis of the proposed control strategies.

The magnet control circuitry of one arrangement is illustrated in FIG. 4. In this example only one coil 18 is situated in any given control sector, but the principle would be identical if a plurality of such coils were in one sector to be controlled in common.

Power for the coils is supplied by a controlled bridge rectifier circuit 30 which applies current to the coil in accordance with the condition of a pulse generator 33 and a phase control circuit 34.

Contact between seal 12 and stator 7 applies a signal voltage to the thyristor phase control circuit 34, which in turn provides a phase control signal being essentially dependent on, and proportional to, the length of the period during which seal and stator are in contact. The low voltage signal current is derived via an isolating transformer 31 and bridge rectifier 32, isolation of this signal supply from the supply to the coils 18 being essential. Transformer 31 powers also, through rectifier bridge 35, the pulse generator 33. The phase control signal determines the proportion of a half cycle of supply voltage over which the thyristors receive triggering pulses generated by pulse generator 33, and thus controls the voltage applied to, and current flowing in, the coil 18. Loss of contact upon movement of the armature 16 is accompanied by the removal of the phase control signal and thus the thyristor triggering pulses. Despite the large inductance of the coil 18, the thyristors are allowed to switch off by the presence of the 'fly-wheel' effect provided by the two diodes in circuit in the controlled bridge rectifier 30.

CONTROL STRATEGY

A number of control strategies are possible, the control circuitry of FIG. 4 representing the requirements of one alternative. The system is effective at all temperatures and the basis of its operation is a continuous cycle of lift and release imposed upon the seal by the magnet and associated control circuitry, the circuitry and system components being designed to limit the withdrawal of the seal to approximately 1 mm. The two thyristors in the controlled bridge receive triggering pulses on contact between the stator end face and the seal segment or sensing shoe and conduct, in turn, for periods dependent on the seal/stator contact time.

This variable conduction time is necessary in order to maintain constant, and satisfactory, make/break ratio for the seal/stator contact, because variations of temperature (and thus coil resistance) and gap length, 'g', demand a variable applied voltage for the provision and control of the energising current required to lift the seal.

The attractive force experienced by the electromagnet when thus energised is just sufficient to lift the seal segment free of the stator, and the triggering pulses are removed from the thyristors. The magnet current then decays around the circuit completed by the bridge diodes, and the seal falls until it again makes contact with the stator end face, whereupon the sequence is repeated. The relatively slow rise and decay of the magnet current due to the high coil inductance are advantageous in that considerable damping is imposed upon the seal motion.

Another possibility is to adopt a strategy based upon a progressive decrease in thyristor conduction time as seal/end face contact is sensed by a seal segment or sensing shoe. In this instance there are a number of different periods over which the thyristors may be triggered, the angle over which there is conduction affecting the point in the appropriate half-cycle at which the gate/cathode signal is applied. Loss of contact between seal and stator end face upon, say, an increase in gas temperature initiates a control sequence wherein the system searches for an optimum condition represented by zero gap between seal and stator but with minimum drag.

The control system achieves this goal through a progressive decrease in conduction time, after each loss of seal/end face contact, until the magnets just fail to lift the seals, contact being thus maintained. A reduction in gas temperature, however, is accompanied by increased drag, so that the control sequence must also be initiated either by a reduction in temperature or after a predetermined period. The preheater 'time constant' is so long that periodical or temperature-dependent initiations of the control sequence may be quite adequate. The control circuitry required for a strategy of this type is a little more complicated than that associated with the binary system described above, and illustrated in FIG. 4, but the logic component involved is not excessive if the number of available conduction angles is limited.

Various other feasible control strategies can be adopted, devised, or envisaged, but the ultimate objective in all instances is to control the lift exerted by a specially designed electro-magnet and, likewise in all instances, the control depends for its efficiency upon a signal derived through contact between system components (namely seal and stator end face) whose time and, particularly, severity of contact is to be minimized. We believe that, due primarily to the hostility of the environment within the preheater, this combination of electro-magnetic seal suspension with simple contact sensing is the only practicable method of achieving feedback control of preheater sealing gaps.

We claim:

1. A rotary regenerative preheater comprising a regenerative mass having two axial end faces and a central axis, ducts for conducting heat-exchange media to and from the regenerative mass, at least one said duct comprising a sealing frame in close axial relationship with one of the end faces of the regenerative mass, means for causing relative rotation of the mass and the at least one sealing frame about the central axis, electrical contact means associated with the end face and with the sealing frame for changing the condition of an electrical circuit upon deviation from a desired said axial relationship of the end face and frame, electromagnetic drive means operatively linked to the sealing frame for altering the axial relationship with the said one end face, and control means responsive to the condition of the said electrical circuit to operate automatically to cause drive of the electromagnetic drive means and effect control of the said axial relationship.

2. A rotary regenerative preheater as claimed in claim 1 wherein the mass is a stator and the sealing frame is on a rotatable hood, the said contact means being on the stator and on the hood the control means being responsive to contact of the electrical contact means.

3. A rotary regenerative preheater as claimed in claim 2 wherein the control means is quantitatively responsive to an angle of arc of rotation over which the said contact occurs.

4. A rotary regenerative preheater as claimed in claim 2 wherein the control means has a time response such that the drive means drive the sealing frame to a predetermined spaced said relationship from the stator, and resilient return means are provided for returning the sealing frame towards a relationship in which there is sealing contact with the stator.

5. A rotary regenerative preheater as claimed in claim 1 wherein said electromagnetic drive means are distributed about the peripheral surfaces of the sealing frame and are controlled in a plurality of control sectors, there being separate control means for each said control sector.

6. A rotary regenerative preheater as claimed in claim 5 wherein at least some of the control sectors are made up of only one electromagnetic drive means.

7. A rotary regenerative preheater as claimed in claim 1 wherein the control means include switch means supplying power to a coil of the electromagnetic drive means in accordance with the condition of the electrical circuit, the sealing means being biased into contact with the stator, the electromagnetic drive means being powerful enough just to overcome that bias and drive the sealing means out of contact with the stator, the response time of the control means being such that closing of the electrical circuit causes the electromagnetic drive means to withdraw the sealing means to at most about 1 mm from the end face and each electromagnetic drive means includes a ferromagnetic circuit including an armature fast with the sealing means movable within the coil and an end plug stationary relative to the coil, an air gap in the ferromagnetic circuit between the armature and the end plug, whereby the air gap is a function of the axial position of the sealing means relative to the coil.

8. In a rotary regenerative preheater with a duct for conducting heat exchange medium to and from a heat-exchange mass, means for causing relative rotation of the duct and the mass about a central axis and an adjustably axially movable sealing means for sealing between the duct and an axial end face of the mass the improvement comprising contact means effective to open and close an electric circuit in dependence on the axial relationship of the sealing means and the said axial end face, electromagnetic drive means for causing axial movement of the sealing means and control means responsive to at least one of the opening and closing of the electric circuit arranged and adapted to respond to said circuit for controlling operation of the electromagnetic drive means to adjust the relationship in the axial direction between the sealing means and the axial end face of the mass.

9. The improvement as claimed in claim 8 wherein the contact means include electrical contact elements on the sealing means and on an end face of a stator regenerative mass to make electrical contact upon physical contact between the shoe and stator, to generate and electrical signal, and include also switched means supplying power to a coil of the electromagnetic drive means in accordance with the electrical signal.

10. The improvement as claimed in claim 9 wherein the switched means are electrically switched by application of pulses from a triggering pulse generator in accordance with the condition of a phase control circuit which receives the electrical signal.

11. A rotary regenerative preheater as claimed in claim 9 wherein the sealing means is biased into contact with the stator, the electromagnetic drive means being powerful enough just to overcome that bias and drive the sealing means out of contact with the stator, the response time of the control means being such that electrical contact between the sealing means and stator causes the electromagnetic drive means to withdraw the shoe sealing means to at most about 1 mm from the stator.

12. A rotary regenerative preheater as claimed in claim 9 wherein the control means causes the electromagnetic drive means to drive in dependence on the angle of arc over which electrical contact continues between sealing means and stator, and the control means comprises logic elements seeking to minimize the said angle of arc of contact.

13. The improvement as claimed in claim 8 wherein each electromagnetic drive means includes a ferromagnetic circuit including an armature fast with the sealing means movable within a coil of the electromagnetic drive means and an end plug stationary relative to the coil, an air gap in the ferromagnetic circuit between the armature and the end plug, whereby the air gap is a function of the axial position of the sealing means relative to the coil.

* * * * *